US009611725B2

(12) United States Patent
Mlcak et al.

(10) Patent No.: US 9,611,725 B2
(45) Date of Patent: Apr. 4, 2017

(54) REDUCED OUTER DIAMETER EXPANDABLE PERFORATOR

(71) Applicant: Halliburton Energy Services, Inc., Houston, TX (US)

(72) Inventors: Matthew Craig Mlcak, Carrollton, TX (US); Scott Alistair Gordon, Frisco, TX (US); Jack Gammill Clemens, Fairview, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 30 days.

(21) Appl. No.: 14/441,146

(22) PCT Filed: Nov. 15, 2012

(86) PCT No.: PCT/US2012/065175
§ 371 (c)(1),
(2) Date: May 6, 2015

(87) PCT Pub. No.: WO2014/077810
PCT Pub. Date: May 22, 2014

(65) Prior Publication Data

US 2015/0300135 A1 Oct. 22, 2015

(51) Int. Cl.
*E21B 43/112* (2006.01)
*E21B 43/119* (2006.01)

(52) U.S. Cl.
CPC ..... *E21B 43/112* (2013.01); *E21B 43/119* (2013.01)

(58) Field of Classification Search
CPC ..... E21B 19/00; E21B 43/112; E21B 43/11
(Continued)

(56) References Cited

U.S. PATENT DOCUMENTS 1,502,375 A * 7/1924 Crum ..... E21B 43/112 166/55.3
1,779,652 A * 10/1930 Wood ..... E21B 43/112 166/55.3

(Continued)

OTHER PUBLICATIONS

International Preliminary Report on Patentability issued in related PCT Application No. PCT/US2012/065175, mailed May 28, 2015 (6 pages).

(Continued)

*Primary Examiner* — Kenneth L Thompson
(74) *Attorney, Agent, or Firm* — Scott Richardson; Baker Botts L.L.P.

(57) ABSTRACT

An apparatus and method for establishing communication between the interior of a downhole tubular string and a surrounding annulus is disclosed. A downhole perforator includes a perforator housing. An inner profile of the perforator housing has a first section having a first diameter and a second section having a second diameter, where the first diameter and the second diameter are different. The downhole perforator also includes a mandrel slidably disposed within the perforator housing having an upper connector coupled to a linear actuator. The mandrel also includes a slot. A penetrator is disposed within the slot and rotatably coupled to the mandrel. Additionally, a platform is disposed along a wall of the perforator housing and abuts the mandrel. A pivot pin is coupled to the perforator housing and interfaces with the penetrator and rotates the penetrator about the mandrel.

18 Claims, 3 Drawing Sheets

(58) Field of Classification Search
USPC ..... 166/55.2, 55.3, 297, 298
See application file for complete search history.

(56) References Cited

U.S. PATENT DOCUMENTS

| | | | | |
|---|---|---|---|---|
| 2,171,442 | A * | 8/1939 | Bynum | E21B 43/112 166/55.3 |
| 2,599,405 | A | 6/1952 | Mennecier | |
| 4,068,711 | A * | 1/1978 | Aulenbacher | E21B 29/005 166/55.3 |
| 4,119,148 | A | 10/1978 | Deardorf | |
| 5,692,565 | A | 12/1997 | Macdougall et al. | |
| 6,772,839 | B1 | 8/2004 | Bond | |
| 7,823,632 | B2 * | 11/2010 | McAfee | E21B 29/005 166/55.7 |
| 2007/0277980 | A1 | 12/2007 | Gordon et al. | |

OTHER PUBLICATIONS

International Search Report and Written Opinion issued in related PCT Application No. PCT/US2012/065175 mailed May 15, 2013, 9 pages.

* cited by examiner

REDUCED OUTER DIAMETER EXPANDABLE PERFORATOR

CROSS-REFERENCE TO RELATED APPLICATION

The present application is a U.S. National Stage Application of International Application No. PCT/US2012/065175 filed Nov. 15, 2012, which is incorporated herein by reference in its entirety for all purposes.

BACKGROUND

Subterranean operations are commonly performed to retrieve hydrocarbons from different formations. A well may be drilled into a formation of interest and various operations may be performed to efficiently retrieve hydrocarbons from the subterranean formation. One of the operations performed in conjunction with performance of subterranean operations is referred to as a "workover." Workovers may include any of several operations on the well to restore or increase production once a reservoir stops producing at the desired rate. Many workover jobs involve treating the reservoir, while other workover jobs involve repairing or replacing downhole equipment. For instance, a workover may be performed in instances when a well has been producing for an extended period of time and hydrocarbon flow rate through the well has decreased or stopped altogether.

In order to keep a well under control while it is being worked over, a workover fluid is commonly circulated downhole. The workover fluid is typically a water-based or oil-based mud that includes a variety of additives to establish certain desirable properties such as high viscosity and the ability to form a wall cake to prevent fluid loss. Additionally, the workover fluid must be of a sufficient weight to overcome formation pressure.

In certain well installations, prior to circulating workover fluid into the well, communication must be established between the interior of a tubular string, such as a casing, a liner, a tubing or the like, and the annulus surrounding the tubular string. One method for establishing such communication is through the use of explosives, such as shaped charges, to create one or more openings through the tubular string. The shaped charges typically include a housing, a quantity of high explosive and a liner. In operation, the openings are made by detonating the high explosive which causes the liner to form a jet of particles and high pressure gas that is ejected from the shaped charge at very high velocity. The jet is able to penetrate the tubular string, thereby forming an opening.

As hydrocarbon producing wells are located throughout the world, it has been found that certain jurisdictions discourage or even disallow the use of such explosives. In these jurisdictions and in other locations where or when it is not desirable to use explosives, mechanical perforators have been used to establish communication between the interior of a tubular string and the surrounding annulus.

Mechanical perforators may utilize a downhole power unit having a power unit housing and a power rod. Additionally, such perforators may have a perforator housing, a mandrel slidably positioned within the perforator housing and a penetrator radially extendable outwardly from the perforator housing. In operation, the power unit housing is coupled to the perforator housing and the power rod is coupled to the mandrel. Thus, when the downhole power unit is activated and the power rod is longitudinally shifted relative to the power unit housing, the mandrel is longitudinally shifted relative to the perforator housing causing at least a portion of the penetrator to extended radial outwardly from the perforator housing.

Typically, penetrators of downhole perforators may include, for example, a rotatable cutting member that is rotatably coupled to the mandrel. Accordingly, the penetrator may rotate and extend radially outwardly relative to the perforator housing when the mandrel is longitudinally shifted relative to the perforator housing. The penetrator has to be long enough to be in contact with the inner wall of the tubular string and perforate the tubular string, but still short enough to be concealed within the mandrel when the downhole perforator is run in and out of the wellbore. Accordingly, the outer diameter of the downhole perforator has to be large enough so that when one side of the tool is in contact with the tubular string, the penetrator on the opposite side of the tool can perforate the tubular string. Due to the large outer diameter of some downhole perforators, they are unable to fit through many common restrictions, for example, in heavier walled tubing.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and are not exhaustive of the scope of the disclosure.

DETAILED DESCRIPTION OF THE DRAWINGS

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells.

The terms "couple" or "couples" as used herein are intended to mean either an indirect or direct connection. Thus, if a first device couples to a second device, that connection may be through a direct connection, or through an indirect mechanical or electrical connection via other devices and connections. The term "uphole" as used herein means along the drillstring or the hole from the distal end towards the surface, and "downhole" as used herein means along the drillstring or the hole from the surface towards the distal end.

The present invention relates generally to establishing communication between the interior of a downhole tubular string and a surrounding annulus, and more particularly, in certain embodiments, to a non-explosive downhole perforator tool with a reduced outer diameter for perforating a downhole tubular string.

Figure 1:
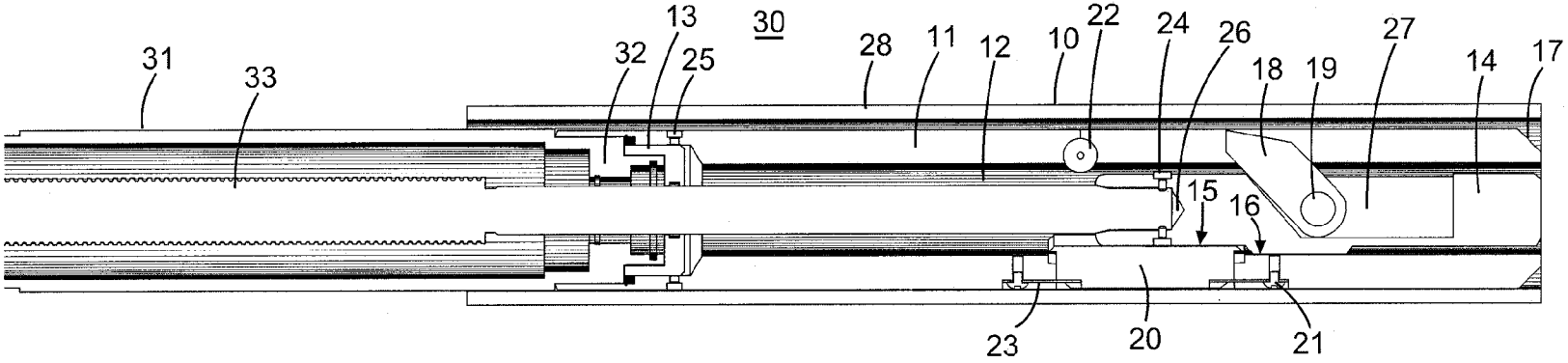
FIG. 1 illustrates a cross-sectional view of a downhole perforator assembly, including a linear actuator and a downhole perforator, in accordance with certain embodiments of the present disclosure.

Referring to FIG. 1, a downhole perforator assembly in accordance with an illustrative embodiment of the present disclosure is denoted generally with reference number 30. The downhole perforator assembly 30 may be located within a wellbore 17 and may be movable along the wellbore axis from a first position to a second position as desired. The methods and systems for lowering components in the wellbore and moving components along the wellbore axis are well known to those of ordinary skill in the art and will therefore not be discussed in detail herein. The downhole perforator assembly 30 may include a linear actuator 31. A linear actuator is an actuator operable to create motion in a straight line. The linear actuator 31 may be a downhole power unit. Although the illustrative embodiment of the Figures depicts the linear actuator 31 as a downhole power unit, the present disclosure is not limited to this particular embodiment. The linear actuator 31 of the downhole perforator assembly 30 may be any suitable linear actuator, as would be appreciated by those of ordinary skill in the art. In certain embodiments in accordance with the present disclosure, when the linear actuator 31 is a downhole power unit, it may further include a power unit housing 32 and a power rod 33. The downhole perforator assembly 30 may further include a downhole perforator 10.

Figure 2:
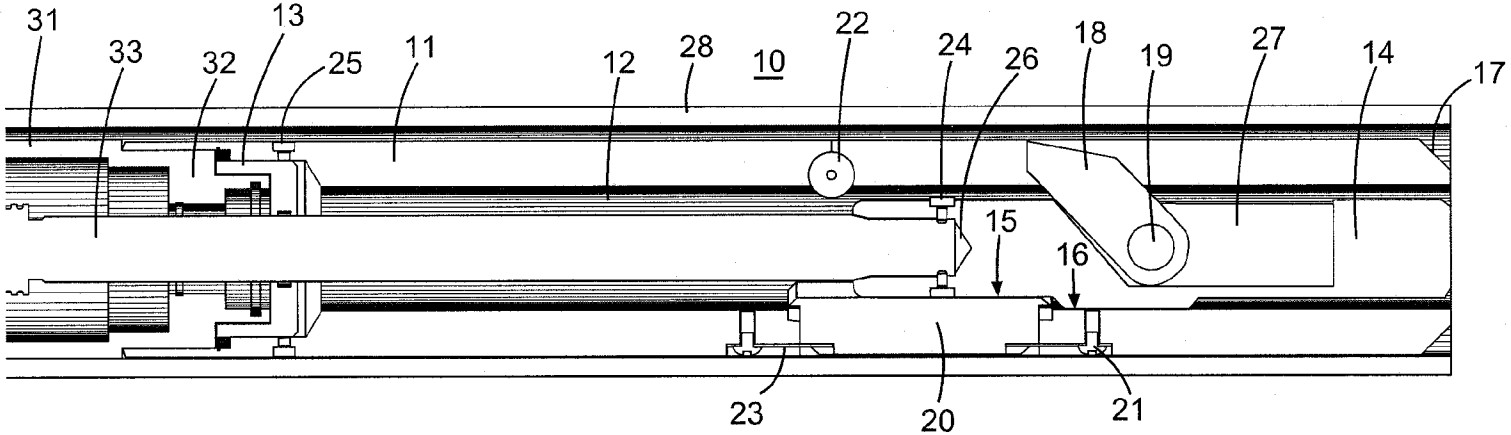
FIG. 2 illustrates a cross-sectional view of the downhole perforator of FIG. 1, shown in a run-in-hole configuration, in accordance with certain embodiments of the present disclosure.

Referring to FIG. 2, the downhole perforator 10 is shown in more detail. The downhole perforator 10 may be located within the wellbore 17. FIG. 2 shows the downhole perforator 10 in a run-in-hole configuration, in accordance with certain embodiments of the present disclosure. The term "run-in-hole configuration" as used herein refers to the configuration of the downhole perforator 10 as it is being inserted downhole and moved to a desired position within the wellbore 17. The downhole perforator 10 may include a perforator housing 11. The perforator housing 11 may have a reduced outer diameter relative to prior art downhole perforators (not shown). The outer diameter of a typical prior art downhole perforator is approximately 3.8 inches, whereas the outer diameter of the perforator housing 11 of the present invention may be reduced, for instance, to approximately 3.59 inches. The perforator housing 11 may include an inner profile 12. The perforator housing 11 may be coupled to the linear actuator 31. In certain embodiments, the inner profile 12 may further comprise a radially reduced section 13 between an upper end of the perforator housing 11 and a lower end of the perforator housing 11 that may allow for coupling with the power unit housing 32. In certain embodiments, the power unit housing 32 may be coupled to the perforator housing 11 by sliding a portion of the power unit housing 32 into the inner profile 12 of the perforator housing 11. Any suitable engagement device may be used to couple the power unit housing 32 to the perforator housing 11. For instance, in certain illustrative embodiments, the power unit housing 32 may be coupled to the perforator housing 11 using one or more set screws 25.

As further shown in FIG. 2, the downhole perforator 10 may further include a mandrel 14 slidably disposed within the inner profile 12 of the perforator housing 11. The mandrel 14 may have two or more sections, each having a different diameter. Specifically, a first section of the mandrel 14 may have a first diameter 15 and a second section of the mandrel 14 may have a second diameter 16, the second diameter 16 being larger than the first diameter 15. Using a mandrel 14 having two sections of varying diameters as shown in FIG. 2, with one section having a larger diameter 16, renders the mandrel 14 less susceptible to failure. Although the illustrative embodiment of FIG. 2 depicts a mandrel having two sections, each having a different diameter, the present disclosure is not limited to this particular implementation. Specifically, the mandrel 14 may include one or more sections with the first diameter 15, and one or more sections with the second diameter 16. In certain embodiments, the section of the mandrel 14 with the second diameter 16 may be positioned between two sections of the mandrel 14 with the first diameter 15.

In certain embodiments, the mandrel 14 may include an upper connector 26 disposed within an upper end of the mandrel 14. The mandrel 14 may be coupled to the linear actuator 31. In certain embodiments, the upper connector 26 may be coupled to the linear actuator 31. In certain illustrative embodiments where the linear actuator 31 is a downhole power unit, the upper connector 26 may be configured to receive the power rod 33 and be coupled thereto. Any suitable engagement device may be used to couple the power rod 33 to the upper connector 26. For instance, in certain illustrative embodiments, the power rod 33 may be coupled to the upper connector 26 of the mandrel 14 using one or more set screws 24. In certain embodiments, the mandrel 14 may further include a slot 27 located therein. The mandrel 14 may further include one or more penetrators 18 disposed within the slot 27. The Figures show one penetrator 19 disposed within the slot 27. However, those skilled in the art will appreciate that the present disclosure is not limited to using a single penetrator. Specifically, other suitable configurations including more than one penetrator 18 may be used without departing from the scope of the present disclosure. The one or more penetrators 18 may be rotatably coupled to the mandrel 14 by any suitable means. For instance, in certain illustrative embodiments, the penetrator 18 may be coupled to the mandrel 14 using a hinge pin 19. In certain embodiments in accordance with the present disclosure, the penetrator 18 may be radially and outwardly extendable outside the perforator housing 11.

As further shown in FIG. 2, the downhole perforator 10 may further include one or more pivot pins 22. The pivot pins 22 may be coupled to the perforator housing 11. The Figures show one pivot pin 22 coupled to the perforator housing 11. However, those skilled in the art will appreciate other suitable configurations including more than one pivot pin 22. As shown in FIG. 2, the pivot pin 22 may also interface with the penetrator 18 and rotate the penetrator 18 about the mandrel 11.

With reference to FIG. 1, in certain embodiments in accordance with the present disclosure, the linear actuator 31 may be coupled to the perforator housing 11 and mandrel 14 of the downhole perforator 10. For instance, in certain illustrative embodiments where the linear actuator 31 is a downhole power unit, the power unit housing 32 may be coupled to the perforator housing 11 of the downhole perforator 10, and the power rod 33 may be coupled to the mandrel 14 of the downhole perforator 10. The linear actuator 31 may be activated when it is desirable to activate the downhole perforator 10. As would be appreciated by those of ordinary skill in the art, having the benefit of the present disclosure, a number of different methods may be used to activate the linear actuator 31. For instance, the linear actuator 31 may be activated by various means, including, but not limited to, timer, pressure, telemetry, acceleration, or temperature. In certain illustrative embodiments in accordance with the present disclosure where the linear actuator 31 is a downhole power unit, activating the linear actuator 31 rotates a shaft (not shown) associated with the linear actuator 31. As would be appreciated by those of ordinary skill in the art, this shaft is coupled to the power rod 33 so that rotation of the shaft moves the power rod 33 linearly along an axis of the downhole perforator 10 that extends along the direction of the wellbore 17 and is referred to herein as the "shaft axis." Accordingly, the power rod 33 moves relative to the power unit housing 32 along this shaft axis and linearly shifts the mandrel 14 relative to the perforator housing 11 along the axis.

In certain embodiments in accordance with this disclosure, and as shown in FIG. 2, the downhole perforator 10 may further include a platform 20 disposed along a wall of the perforator housing 11. The platform 20 may abut the mandrel 14. In the run-in-hole configuration shown in the illustrative embodiment of FIG. 2, the platform 20 may abut a section of the mandrel 14 with the first diameter 15. The platform 20 may be coupled at an upper end and a lower end to one or more springs 23 positioned above and/or below the platform 20. The springs 23 may be held in place by one or more screws 21 disposed along the wall of the perforator housing 11. The springs 23 may be biased to allow the platform 20 to be extended outside the perforator housing 11 into an expanded position and retracted back inside the perforator housing 11 into a retracted position as they move between the expanded position and the retracted position, respectively.

Figure 3:
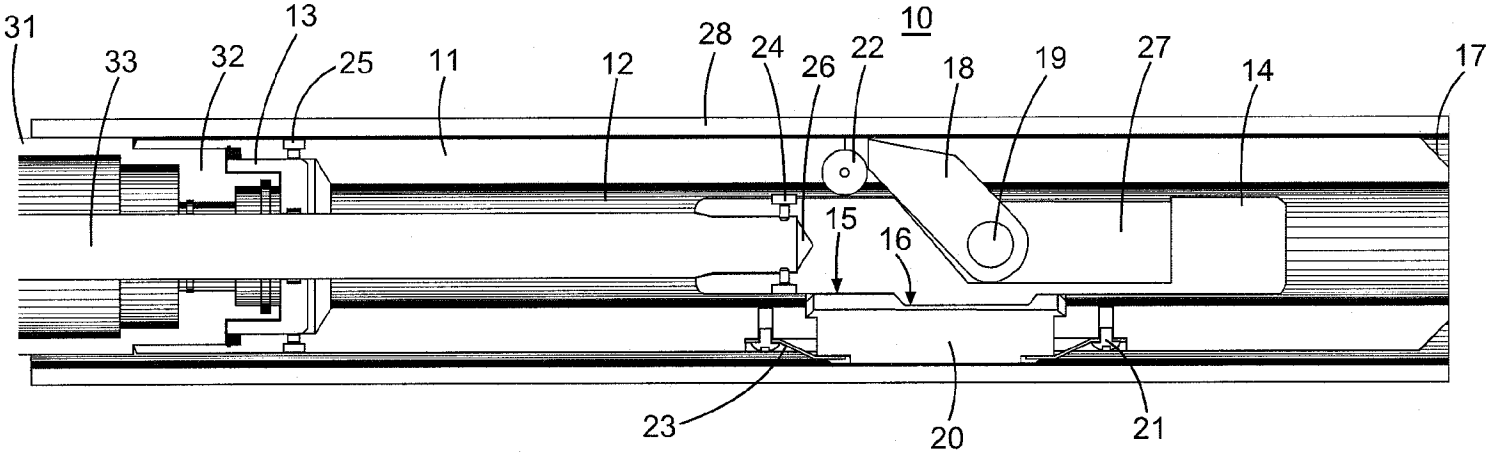
FIG. 3 illustrates a cross-sectional view of the downhole perforator of FIG. 1, shown in an expanded configuration, in accordance with certain embodiments of the present disclosure.

Referring to FIG. 3, the downhole perforator 10 of FIG. 2 is shown in an expanded configuration in accordance with an illustrative embodiment of the present disclosure. As discussed above, activating the linear actuator 31 may cause the mandrel 14 to shift relative to the perforator housing 11 along the shaft axis. In certain embodiments, as the mandrel 14 shifts towards the linear actuator 31, the second section of the mandrel 14 with the second diameter 16 may abut the platform 20. The second section of the mandrel 14 with the second diameter 16 may push the platform 20 outward towards the inner wall of a tubular string 28 in the wellbore 17, while the platform 20 is loaded with force applied by the springs 23. The platform 20 may extend outside the perforator housing 11, and in certain embodiments, may abut the inner wall of tubular string 28 in the wellbore 17. In an embodiment as illustrated in FIG. 3, the platform 20 in expanded position may urge the perforator housing 11 towards an inner wall of the tubular string 28 opposite the platform 20.

Figure 4:
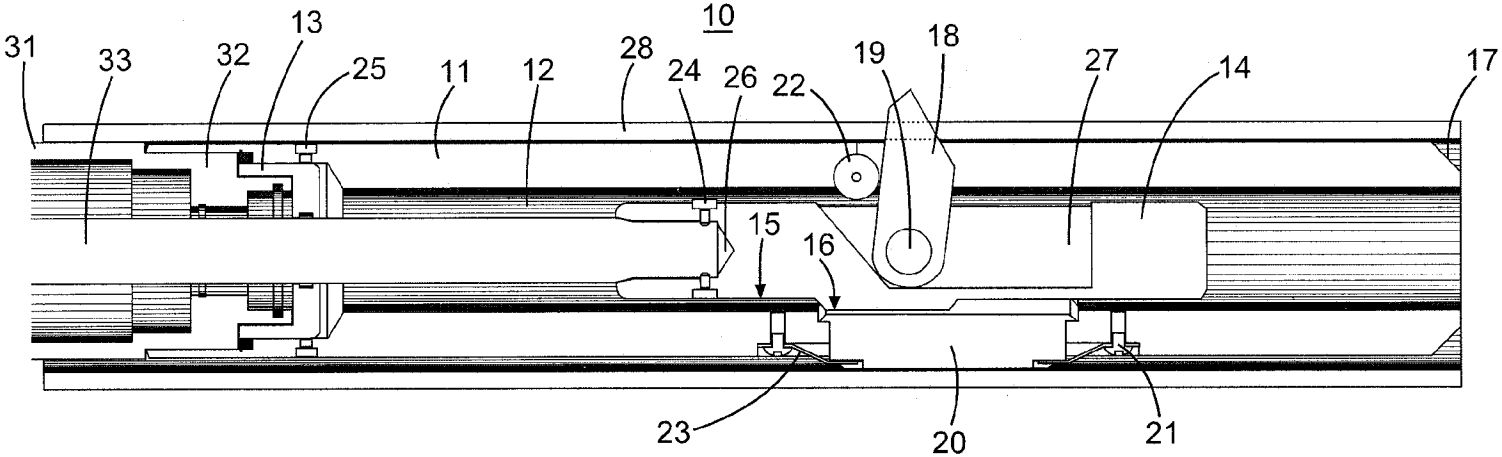
FIG. 4 illustrates a cross-sectional view of the downhole perforator of FIG. 1, shown in a perforating configuration, in accordance with certain embodiments of the present disclosure.

Referring to FIG. 4, the downhole perforator 10 of FIG. 2 is shown in a perforated configuration in accordance with an illustrative embodiment of the present disclosure. As the mandrel 14 shifts uphole towards the linear actuator 31, at least a portion of the penetrator 18 may abut the pivot pin 22, as shown in FIG. 4. As the mandrel 14 continues to shift uphole towards the linear actuator 31, the pivot pin 22 may interface with the penetrator 18 and rotate the penetrator 18 about the hinge pin 19. As the penetrator 18 rotates, at least a portion of the penetrator 18 may be extended radially and outwardly outside the perforator housing 11. In an embodiment as illustrated, the platform 20, in an expanded position may reduce the reach that is needed by the penetrator 18 to contact and perforate the tubular string 28. The Figures show one perforator 18, one hinge pin 19, and one pivot pin 22. However, those skilled in the art will appreciate other suitable configurations including more than one perforator 18, more than one hinge pin 19, and more than one pivot pin 22.

Figure 5:
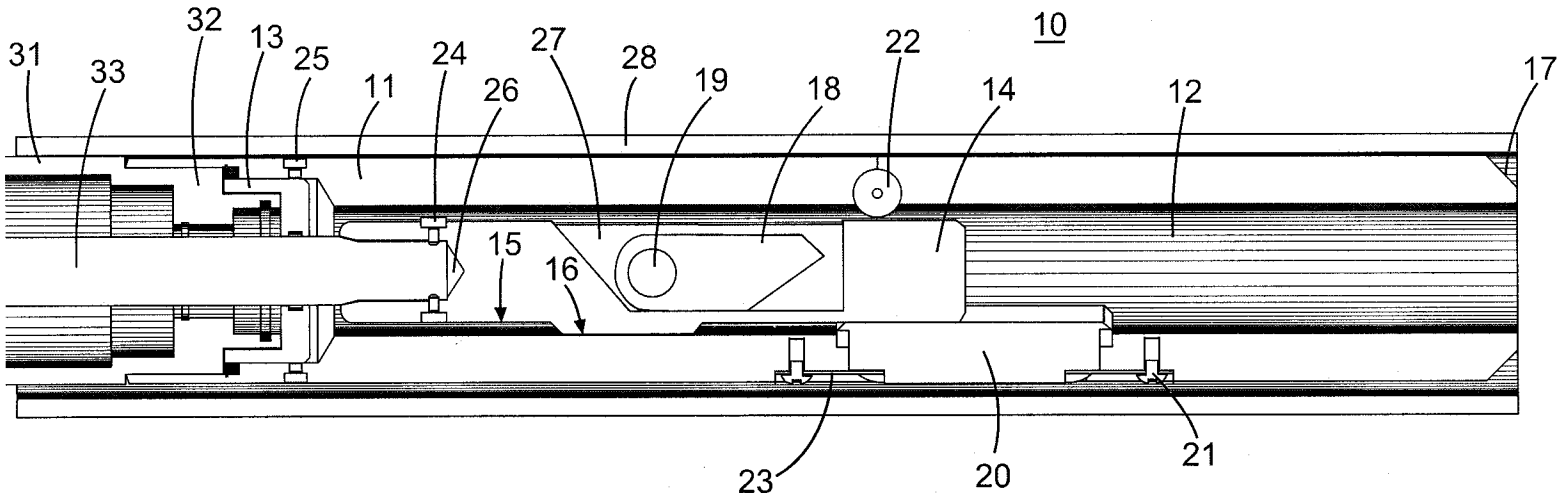
FIG. 5 illustrates a cross-sectional view of the downhole perforator of FIG. 1, shown in a retracted configuration, in accordance with certain embodiments of the present disclosure.

Referring to FIG. 5, the downhole perforator 10 of FIG. 2 is shown in a retracted configuration, after it has made the desired penetration. Continued uphole shifting of the mandrel 14 relative to the perforator housing 11 continues to rotate penetrator 18 about the hinge pin 19. In the illustrative embodiment of FIGS. 2-5, the penetrator 18 is arranged so that after penetrating the tubular string 28 it continues to rotate clockwise about the hinge pin 19 until it is retracted into the perforator housing 11 and housed within the slot 27 of the mandrel 14. In this manner, the downhole perforator 10 may create a longitudinal cut through the wall of the tubular string 28. Further, as the mandrel 14 continues to shift uphole, the section of the mandrel 14 with the second diameter 16 may no longer abut the platform 20. When the section of the mandrel 14 with the second diameter 16 no longer abuts the platform 20, the platform 20 may be retracted back inside the perforator housing 11. In certain embodiments, the springs 23 coupled to the platform 20 may cause the platform 20 to retract back inside the perforator housing 11 via a spring force. When the penetrator 18 and the platform 20 are retracted into the perforator housing 11, the downhole perforator 10 is in a reduced outer diameter mode.

In certain embodiments, the linear actuator 31 may have a set run time. As shown in FIG. 5, at the end of the linear motion of the power rod 33, the shaft (not shown) of the linear actuator 31 may be in a "free-wheel" position. "Free-wheel" as used herein means that the shaft (not shown) of the linear actuator 31 may continue to rotate without any linear motion of the power rod 33 until the linear actuator 31 run time is completed.

It may be desirable to create multiple perforations in the tubular string 28. In certain embodiments in accordance with the present disclosure, the downhole perforator assembly 30 may be moved from a first position in the wellbore 17 to a second position in the wellbore 17 in the reduced outer diameter mode. The linear actuator 31 may be configured to initiate a downhole linear motion at the end of a first completed perforation and once the downhole perforator assembly 30 has been moved to a desired location. The downhole linear motion will cause the mandrel 14 to shift downhole relative to the perforator housing 11 along the shaft axis. In certain embodiments, as the mandrel 14 shifts away from the linear actuator 31, the second section of the mandrel 14 with the second diameter 16 may abut the platform 20 and may push the platform 20 outward towards the inner wall of a tubular string 28 in the wellbore 17, as discussed with respect to the expanded configuration shown in FIG. 3. Moreover, as the mandrel 14 shifts downhole away from the linear actuator 31, the penetrator 18 may be positioned so that at least a portion of the penetrator 18 may be extended radially and outwardly outside the perforator housing 11, as discussed in the perforated configuration shown in FIG. 4. The mandrel 14 and the slot 17 may be configured to house the penetrator 18 in a position suitable to extend the penetrator 18 radially and outwardly as the mandrel 14 shifts downhole away from the linear actuator 31. One or more pivot pins 22 may be utilized to rotate the penetrator 18 about the hinge pin 19 as the downhole perforator is moving uphole and downhole. In this manner, the downhole perforator 10 may create a second longitudinal cut through the wall of the tubular string 28. As would be appreciated by those of ordinary skill in the art having the benefit of this disclosure, the linear actuator 31 may be configured to linearly move the downhole perforator 10 uphole and downhole, thereby moving the downhole perforator 10 between the expanded position and the retracted position multiple times, and thereby creating multiple longitudinal cuts through the wall of the tubular string 28.

As would be appreciated by those of ordinary skill in the art having the benefit of this disclosure, the downhole perforator 10 may be used to perforate a tubular string 28 disposed within a wellbore 17. Accordingly, in certain implementations the downhole perforator 10 may be utilized to produce consistent holes in a controlled environment without the use of explosives.

Moreover, as would be appreciated by those of ordinary skill in the art having the benefit of this disclosure, the downhole perforator 10 may be in a reduced outer diameter mode in its run-in-hole configuration (shown in FIG. 1), allowing the downhole perforator 10 to fit through many common restrictions, including small restrictions present in completions involving heavy weighted tubing. In the reduced outer diameter mode, the platform 20 may be collapsed into the housing 11 with one or more springs 23 holding it in place. The downhole perforator 10 may switch to an expanded outer diameter mode once it reaches a location of interest. In the expanded outer diameter mode, the platform 20 will extend to its expanded position as a result of the force applied thereto by the mandrel 14 as it shifts uphole through the downhole perforator 10. As a result, once the downhole perforator 10 is in its expanded outer diameter mode, it may reduce the reach needed by the penetrator 18 to perforate the tubular string 28 by pushing the portion of the perforator housing 11 across from the platform 20 closer to the tubular string 28. Once the penetrator 18 has perforated the tubular string 28, and both the penetrator 18 and the platform 20 are retracted into the perforator housing 11, the downhole perforator 10 returns to the reduced outer diameter mode and may be retrieved from the wellbore 17.

As would be appreciated by those of ordinary skill in the art, with the benefit of this disclosure, the downhole perforator 10 in accordance with embodiments of the present disclosure may have an expandable mandrel functionality that includes an extendable platform 20. The expandable mandrel functionality allows the downhole perforator 10 to have a reduced outer diameter while being run in and out of the wellbore 17, and expandable features to reduce the reach needed by the one or more penetrators 18 to perforate the inner wall of the tubular string 28. Accordingly, the reduced outer diameter of the downhole perforator 10 may allow for perforations in heavy weighted tubing or in tubing with small restrictions. The reduced outer diameter perforator may also allow for perforations in light weight tubing or in tubing with large restrictions due to use of the expander mandrel functionality.

Accordingly, a mechanical perforator tool is provided with a reduced outer diameter such that the perforator tool is able to fit through smaller restrictions found in completions while still being operable to establish communication between the interior of a tubular string and the surrounding annulus without the use of explosives.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. For example, many of the features could be moved to different locations on respective parts without departing from the spirit of the invention. Furthermore, no limitations are intended to be limited to the details of construction or design herein shown, other than as described in the claims below. It is therefore evident that the particular illustrative embodiments disclosed above may be altered or modified and all such variations are considered within the scope and spirit of the present invention. Moreover, the indefinite articles "a" or "an," as used in the claims, are defined herein to mean one or more than one of the element that it introduces. Also, the terms in the claims have their plain, ordinary meaning unless otherwise explicitly and clearly defined by the patentee.

What is claimed is:

1. A downhole perforator comprising:

a perforator housing, wherein an inner profile of the perforator housing has a first section having a first diameter and a second section having a second diameter, wherein the first diameter and the second diameter are different;

a mandrel slidably disposed within the perforator housing comprising:

an upper connector; and a slot;

a penetrator disposed within the slot and rotatably coupled to the mandrel;

a platform disposed along a wall of the perforator housing and abutting the mandrel, wherein the platform is configured to extend at least partially outside the perforator housing; and a pivot pin coupled to the perforator housing wherein the pivot pin interfaces with the penetrator and rotates the penetrator about the mandrel.

2. The downhole perforator of claim 1, wherein the second diameter is larger than the first diameter.

3. The downhole perforator of claim 1, wherein the penetrator is coupled to the mandrel using a hinge pin.

4. The downhole perforator of claim 1, wherein the platform is coupled at a first end and a second end to one or more springs.

5. The downhole perforator of claim 4, wherein the springs are held in place by one or more screws disposed along a wall of the perforator housing.

6. The downhole perforator of claim 1, wherein the platform is movable between an expanded position and a retracted position.

7. The downhole perforator of claim 1, wherein the inner profile comprises a radially reduced section between an upper end of the perforator housing and a lower end of the perforator housing.

8. A downhole perforator assembly comprising:

a linear actuator;

a downhole perforator comprising:

a perforator housing, wherein an inner profile of the perforator housing has a first section having a first diameter and a second section having a second diameter, wherein the first diameter and the second diameter are different;

a mandrel slidably disposed within the perforator housing comprising:

an upper connector; and a slot;

one or more penetrators disposed within the slot and rotatably coupled to the mandrel;

a platform disposed along a wall of the perforator housing and abutting the mandrel; and one or more pivot pins coupled to the perforator housing wherein the one or more pivot pins interface with the one or more penetrators and rotate the penetrator about the mandrel;

wherein the linear actuator is operable to move the mandrel between a first position and a second position and wherein the linear actuator is operable to at least one of extend at least a portion of the platform outside the perforator housing and retract the portion of the platform into the perforator housing; and wherein the one or more penetrators are disposed within the slot when the mandrel is in the first position and wherein the one or more penetrators are extended out of the slot when the mandrel is in the second position.

9. The downhole perforator assembly of claim 8, wherein the upper connector and the linear actuator are coupled using one or more set screws.

10. The downhole perforator assembly of claim 8, wherein the linear actuator is a downhole power unit further comprising a power unit housing and a power rod, and wherein the power rod is coupled to the upper connector and wherein the power unit housing is coupled to the perforator housing.

11. The downhole perforator assembly of claim 10, wherein moving the mandrel between the first position and the second position comprises activating the downhole power unit to linearly shift the power rod relative to the power unit housing along a shaft axis substantially parallel to a wellbore axis, thereby linearly shifting the mandrel relative to the perforator housing along the shaft axis.

12. The downhole perforator assembly of claim 8, wherein the linear actuator is operable to at least one of extend a portion of at least one of the one or more penetrators outside the perforator housing and retract the portion of the penetrator into the perforator housing.

13. A method for perforating a tubular string disposed within a wellbore comprising the steps of:

providing a linear actuator;

providing a downhole perforator comprising:

a perforator housing, wherein an inner profile of the perforator housing has a first section having a first diameter and a second section having a second diameter, wherein the first diameter and the second diameter are different;

a mandrel slidably disposed within the perforator housing comprising:

an upper connector; and a slot;

one or more penetrators disposed within the slot and rotatably coupled to the mandrel;

a platform disposed along a wall of the perforator housing and abutting the mandrel; and one or more pivot pins coupled to the perforator housing wherein the one or more pivot pins interface with the one or more penetrators and rotate the penetrators about the mandrel;

coupling the linear actuator to the perforator housing;

coupling the linear actuator to the mandrel; and activating the linear actuator, wherein activating the linear actuator moves the mandrel between a first position and a second position and wherein the linear actuator is operable to at least one of extend at least a portion of the platform outside the perforator housing and retract the portion of the platform into the perforator housing.

14. The method of claim 13, wherein activating the linear actuator linearly shifts the mandrel relative to the perforator housing along a shaft axis substantially parallel to a wellbore axis.

15. The method of claim 13, wherein the linear actuator is operable to at least one of extend a portion of at least one of the one or more penetrators outside the perforator housing and retract the portion of the penetrator into the perforator housing.

16. The method of claim 13, wherein the second diameter is larger than the first diameter.

17. The method of claim 13, wherein at least a portion of the platform extends outside the perforator housing when the mandrel moves from the first position to the second position.

18. The method of claim 13, wherein at least a portion of at least one of the one or more penetrators extends outside the perforator housing when the mandrel moves from the first position to the second position.

* * * * *